US008061011B2

(12) United States Patent
Yu et al.

(10) Patent No.: US 8,061,011 B2
(45) Date of Patent: Nov. 22, 2011

(54) METHOD FOR MAKING GOLF CLUB HEADS USING POLISHING MARKS

(75) Inventors: Joseph Yu, Kaohsiung (TW); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 282 days.

(21) Appl. No.: 12/466,024

(22) Filed: May 14, 2009

(65) Prior Publication Data

US 2010/0120554 A1 May 13, 2010

Related U.S. Application Data

(60) Provisional application No. 61/128,774, filed on May 22, 2008.

(51) Int. Cl.
*B23P 13/04* (2006.01)
*B23P 25/00* (2006.01)

(52) U.S. Cl. ..... 29/558; 29/527.5; 451/54; 451/56

(58) Field of Classification Search ..... 29/225, 29/527.5, 558; 473/324; 451/8, 10, 11, 28, 451/54, 55, 68, 71

See application file for complete search history.

(56) References Cited

U.S. PATENT DOCUMENTS

| | | | | |
|---|---|---|---|---|
| 3,230,671 | A * | 1/1966 | Rampe | 451/32 |
| 5,232,224 | A * | 8/1993 | Zeider | 473/345 |
| 5,377,986 | A * | 1/1995 | Viollaz et al. | 473/330 |
| 6,305,063 | B1 * | 10/2001 | Ashcraft et al. | 29/418 |
| 6,497,629 | B2 * | 12/2002 | Takeda | 473/324 |
| 6,524,196 | B1 * | 2/2003 | Yeh | 473/324 |
| 2002/0004265 | A1 * | 1/2002 | Vepa et al. | 438/200 |
| 2002/0016218 | A1 * | 2/2002 | Takeda | 473/324 |
| 2004/0147343 | A1 * | 7/2004 | Billings et al. | 473/349 |
| 2005/0034835 | A1 * | 2/2005 | Tsai | 164/76.1 |
| 2005/0115049 | A1 * | 6/2005 | Huang | 29/509 |

* cited by examiner

*Primary Examiner* — David Bryant
*Assistant Examiner* — Jacob Cigna
(74) *Attorney, Agent, or Firm* — Klarquist Sparkman LLP

(57) ABSTRACT

Certain disclosed embodiments concern making sports equipment, such as golf club heads, using polishing marks to facilitate removing material from as-cast work pieces to produce a final thickness within a desired specification, such as 0.6 millimeter or less ±0.05 millimeter. At least one polish mark, more typically plural polish marks, is formed into an outer surface of an as-cast article to a depth selected to provide a final product thickness subsequent to polishing that is ±0.05 millimeter of a final desired thickness. The golf club head or component is then polished at least once to remove club head material substantially corresponding to the depth of the at least one polish mark. The method may further comprise joining the club head to a shaft.

26 Claims, 8 Drawing Sheets

METHOD FOR MAKING GOLF CLUB HEADS USING POLISHING MARKS

CROSS-REFERENCE TO RELATED APPLICATIONS

This application claims the benefit of U.S. Provisional Application No. 61/128,774, filed May 22, 2008, which is incorporated herein by reference in its entirety.

FIELD

This invention concerns a method for making golf clubs, particularly golf club heads, using polishing marks to obtain accurate thicknesses of thin cast portions, and golf clubs made according to the method.

BACKGROUND

Modern metal-wood golf clubs typically include a hollow shaft having a lower end to which the club head is attached. The club head comprises a body and may further comprise a strike plate (also called a face plate) that is attached to the club head body. Club heads also typically are hollow and have thin club head walls. These features have allowed club head volume to increase substantially. But, volume increases are accompanied by an undesirable increase in club head weight unless the mass of material used to make the club head also decreases.

One method for reducing or substantially maintaining mass while increasing volume is to reduce the thickness of the club head wall. For a typical titanium alloy "metal-wood" club head having a volume of 460 cubic centimeters (e.g. a driver) and a crown area of 100 $cm^2$, the thickness of the crown is typically about 0.8 millimeter, and the mass of the crown is about 36 g. Reducing the wall thickness, such as by 0.2 millimeter, would provide a substantial mass reduction.

However, golf club heads having a wall thickness, or some other portion, that is below a certain critical thickness cannot be produced solely by machining or a metal casting process alone. Casting thin walled structures is difficult because it requires forcing material into a corresponding narrow portion of a casting mold before consolidation. Greater force must be applied to urge molten metal fully and completely into the casting mold cavity. Narrower mold cavities and higher pressures increase the probability of turbulent metal flow into the casting mold cavities, which is known to generate casting defects.

Cast golf club components typically are subjected to a finishing process, such as a polishing process, that reduces the thickness of the as-cast article to desired specifications. These mechanical polishing processes must be precisely controlled to produce a final club head having a thickness, particularly in thin cast portions, that is within acceptable tolerances.

SUMMARY

The present process addresses problems associated with producing golf club heads having portions that are too thin to be produced solely by a machining or casting process. Disclosed embodiments of the process are useful for producing golf club heads or components thereof having portions with a thickness of less than about 0.8 millimeter, more typically about 0.6 millimeter or less. Certain disclosed embodiments concern using polishing marks to facilitate removing material from as-cast work pieces to produce a final thickness within a desired specification, such as 0.6 millimeter or less ±0.05 millimeter.

One disclosed embodiment comprises casting, such as investment casting, a golf club head to produce a casting having an outer as-cast surface. The casting can be made from any metal or metal alloy now known or hereafter developed that is useful for forming club heads, or components thereof, such as but not limited to, titanium and titanium alloys. At least one polish mark is formed into an outer surface of the as-cast article to a depth selected to provide a final product thickness subsequent to polishing that is ±0.05 millimeter of a final desired thickness. Working embodiments have formed plural polishing marks on the club head, such as greater than 1 to about 550 total polish marks. Plural polish marks typically are formed on the crown, skirt, and on sole of the golf club head. For certain disclosed working embodiments, from about 30 to about 50 marks were formed on the crown, from about 10 to about 30 marks were formed on the skirt, and from about 10 to about 20 marks were formed on the sole. The plural polish marks may be substantially evenly spaced on the golf club head or component thereof, may be unevenly spaced, or a portion of the plural marks may be substantially evenly spaced and a portion of the marks unevenly spaced on the golf club head or component thereof. The polish marks may be formed by any suitable method, such as by drilling.

The golf club head or component is then polished at least once to remove club head material substantially corresponding to the depth of the at least one polish mark.

Typical processes generally involve performing an initial polish followed by at least a second polish. These first and second polishes may be done using the same polishing grit or different polishing grits. For certain disclosed working embodiments, an initial polish was performed using a first grit, such as a #180 polish, and a second polish was performed using a different grit, such as a #320 polish. Following the at least one second polish, about 99% of club heads produced by the method have a desired thickness, such as from about 0.50 to about 0.60 millimeter ±0.05 millimeter. Once the club head is substantially at a desired thickness within acceptable tolerances, the method may further comprise joining the club head to a shaft.

Golf club heads also are described. One disclosed embodiment is directed to a golf club head having a wall portion with a thickness of from about 0.50 to about 0.65 millimeter ±0.05 millimeter.

DETAILED DESCRIPTION

This disclosure is set forth in the context of representative embodiments. These embodiments are not intended to limit the invention to a scope narrower than would be appreciated by a person of ordinary skill in the art.

I. Introduction and Definitions

Unless otherwise noted, technical terms are used according to conventional usage.

Any numerical values recited herein include all values from the lower value to the upper value. All possible combinations of numerical values between the lowest value and the highest value enumerated herein are expressly included in this application.

As used herein, the singular terms "a," "an," and "the" include plural referents unless context clearly indicates otherwise. Similarly, the word "or" is intended to include "and" unless the context clearly indicates otherwise. Also, as used herein, the term "comprises" means "includes." Hence "comprising A or B" means including A, B, or A and B.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over.

II. Club Heads

Figure 1:
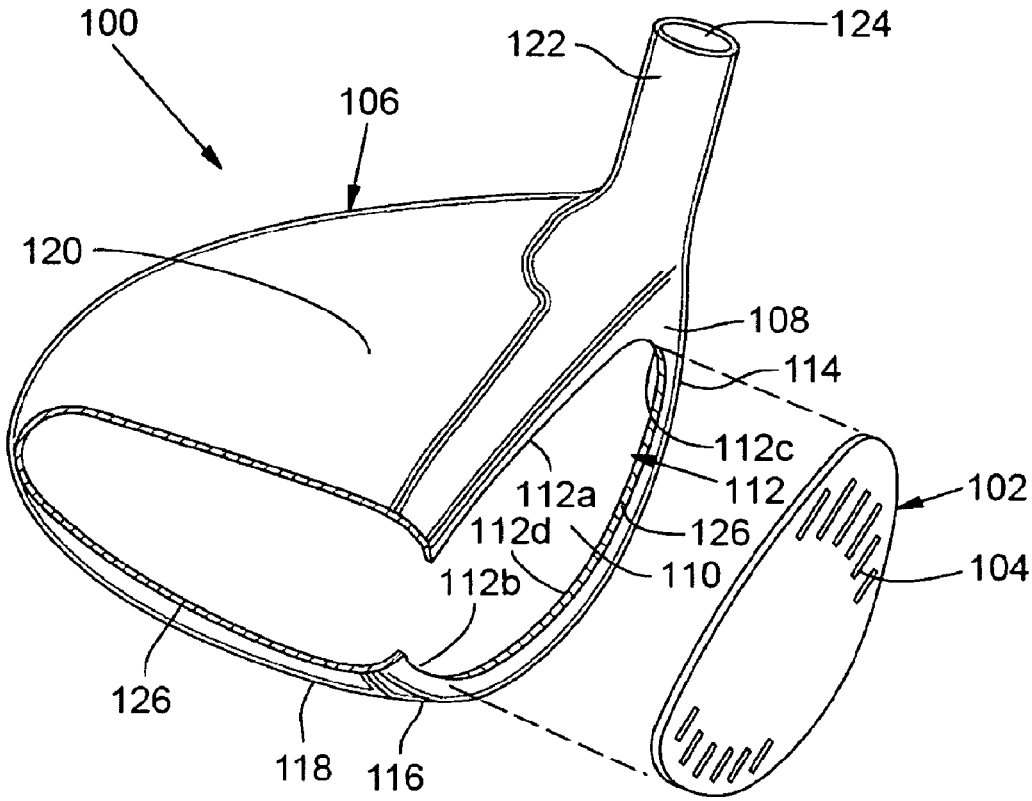
FIG. 1 is a perspective view illustrating certain features of a golf club head.

Particular features of an exemplary club head 100, such as a driver head, are depicted in FIG. 1. Club heads having other structural features and/or components also can be made according to disclosed embodiments of the present invention. Club head 100 comprises a face plate 102 and a body 106. The face plate 102 typically is convex, and has an external ("striking") surface (face) 104. The body 106 defines a front opening 110 into a hollow interior. A face support 112 is disposed about the front opening 110. The body 106 also has a heel 114, a toe 116, a sole 118, a top or crown 120, and a hosel 122. Hosel 122 defines an opening 124 for receiving a distal end of a shaft (not shown). The opening 110 receives the face plate 102, which rests upon and is bonded to the face support 112 and transition zone 108, thereby enclosing the front opening 110. The transition zone 108 includes a crown-lip region 112*a*, a toe-lip region 112*b*, a heel-lip region 112*c*, and a sole-lip region 112*d*.

The crown, skirt, striking plate, and sole define a club head volume. The club head volume typically is between about 300 cubic centimeters and 500 cubic centimeters. Modern golf club heads typically have a total mass of between about 150 grams and 300 grams. In some examples, the club head volume is between about 350 cubic centimeters and about 460 cubic centimeters, and the golf club head has a total mass between about 190 grams and about 210 grams. For disclosed embodiments of the present invention, each portion of the golf club head has a thickness 126 of between about 0.50 millimeter and about 0.8 millimeter, more typically between about 0.50 millimeter and about 0.70 millimeter, and even more typically between about 0.55 and about 0.65 millimeter.

III. Investment Casting

Golf club heads typically are not machined, but instead are made by a casting process, such as investment casting. Investment casting requires first forming an initial sacrificial pattern made of casting "wax". Injection molding is one method for forming the pattern. A suitable injection die can be made of aluminum or other suitable alloy or other material by a computer-controlled machining process using a casting master to form the top and bottom halves of the casting mold, while the mold core is machined using a computer numerical control (CNC) process. Mold cavity dimensions are established to compensate for linear and volumetric shrinkage of the casting wax encountered during casting of the initial pattern, and to compensate for shrinkage encountered during the metal casting process using an investment-casting "shell" formed from the initial pattern.

A casting shell is constructed by serially applying layers of a ceramic composition to the pattern, such as immersing the pattern into a liquid ceramic slurry. This step may be followed by immersion in a bed of refractory particles. This immersion sequence is repeated as required to build up a sufficient wall thickness of ceramic material around the casting cluster, thereby forming an investment casting shell. Different slurries can be used to provide layers of different material to form the casting shell. An exemplary immersion sequence includes six dips of the casting cluster in liquid ceramic slurry and five dips in the bed of refractory particles, yielding an investment casting shell comprising alternating layers of ceramic and refractory material. The first two layers of refractory material desirably comprise fine (e.g. 300 mesh) zirconium oxide particles, and the third-to-fifth refractory material layers can comprise coarser (e.g. 200 mesh to 35 mesh) aluminum oxide particles. Each layer is dried at a controlled temperature (25±5° C.) and relative humidity (50±5%) before applying the subsequent layer.

The casting wax pattern is now encompassed by a ceramic shell. The pattern is removed from the shell, such as by melting the wax using injected steam. Removing the pattern produces a cavity for receiving molten metal or metal alloy. The shell is then sintered, such as in a range of from about 1,000° C. to about 1,300° C., to remove residual wax and to increase the shell strength. The shell is now ready for investment casting.

Modern investment casting of titanium alloys is usually performed while rotating the casting shell in a centrifugal manner to harness and exploit the force generated by $\omega^2 r$ acceleration of the shell undergoing such motion, where w is the angular velocity of the shell and r is the radius of the angular motion. This rotation is performed using a turntable situated inside a casting chamber under a subatmospheric pressure. The force generated by the $\omega^2 r$ acceleration of the shell urges the molten metal to flow into the mold cavities. The investment-casting shell (including its constituent clusters and runners) is generally assembled outside the casting chamber and heated to a pre-set temperature before being placed as an integral unit on the turntable in the chamber. After mounting the shell to the turntable, the casting chamber is sealed and evacuated to a pre-set subatmospheric-pressure ("vacuum") level. As the chamber is being evacuated, the molten alloy for casting is prepared and the turntable is rotated. When the molten metal is ready for pouring into the shell, the casting chamber is at the proper vacuum level, the casting shell is at a suitable temperature, and the turntable is spinning at the desired angular velocity. Thus, the molten metal is poured into the receptor of the casting shell and flows throughout the shell to fill the mold cavities in the shell.

Investment casting produces articles having substantial variation in part thickness. For example, as-cast articles have a variable thickness of about ±0.13 millimeter. This variance can produce thickness variations ranging from +0.13 millimeter to −0.13 millimeter, for a total thickness variation of about 0.26 millimeter. If the golf club head has a final desired wall thickness of 0.50 millimeter, and casting produces thickness variations of ±0.13 millimeter, then portions of the wall may be only 0.37 millimeter thick. This is too thin, and a golf club head having such a thin wall may fail on impact.

IV. Post Cast Polishing As-Cast Golf-Club Heads or Golf-Club Head Components

As-cast articles do not meet the thickness and thickness tolerance requirements established for club heads according to the present invention. Instead, as-cast club heads are subjected to a polishing process to produce a wall having desired thicknesses that are within the desired ±0.05 millimeter thickness variation tolerance. As used herein, "thin walled" typically refers to articles having a final target thickness, such as a wall thickness, of less than about 0.8 millimeter, more typically less than about 0.65 millimeter. Disclosed embodiments of the present invention can be used to control final article thickness to be within +0.1/−0.05 millimeter, with acceptable efficiency. The tightest tolerance possible with current processes is ±0.07 millimeter, without a loss in production efficiency.

Figure 2:
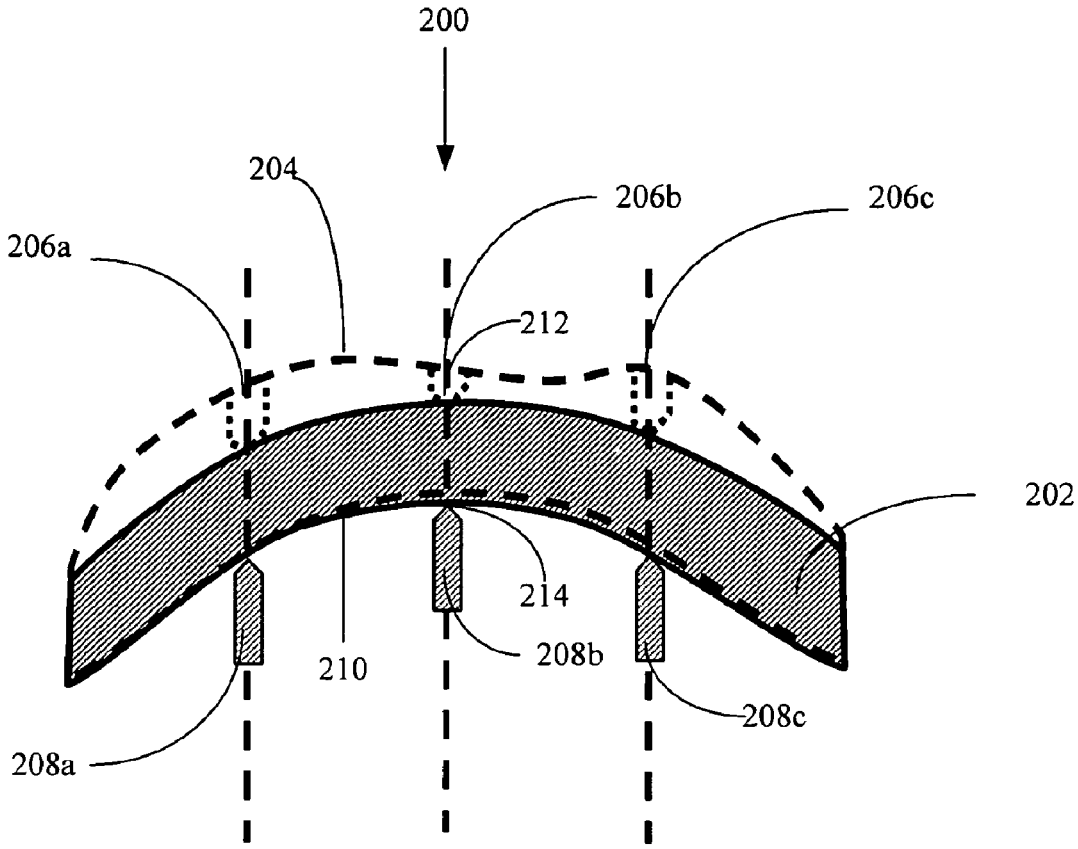
FIG. 2 is a schematic drawing of an as-cast (AC) club component, illustrating polish marks and expected dimension reduction achieved by polishing.

FIG. 2 illustrates a cast article, such as an as-cast club or club component 200. Article 200 has a final desired article thickness illustrated by cross-hatched section 202. As cast, article 200 has a first thickness, illustrated by outer surface 204. The outer surface 204 represents the likely thickness of a club head component made by an investment casting process. The as-cast thickness also can vary along the article.

Plural polish marks, such as marks 206*a*-206*c*, are formed at various locations along outer surface 204 and to a preselected depth. Polish marks 206*a-c* are formed to a particular depth to guide polishing and removal of excess material produced during the casting process.

FIG. 2 also indicates one method for forming polish marks 206 with sufficient accuracy to produce a final, thin-walled article having a thickness variation of ±0.05 millimeter. FIG. 2 illustrates using plural stops 208*a*-208*c* adjacent a surface 210 opposite contour surface 204. Commercially available automated drill presses, such as the Delta SM300, Shopmaster 10" drill press, are capable of forming a polish mark 206 such that the distance between the floor 212 of the polish mark and the top 214 of stop 208 is precisely controlled. Using this method, polish marks 206 can be formed to precise depths even if the outer surface 204 is not constant, which it typically is not for as-cast articles.

For certain disclosed embodiments, strike plate 102 is not cast integrally with the rest of the club head. Moreover, club head 100 is hollow. Therefore, a stop 208 can be inserted into the club head cavity through front opening 110 to allow precise formation of the polish marks 206. A person of ordinary skill will understand that polish marks 206 may be formed to a constant depth using an appropriate stop or stops 208. Alternatively, polish marks 206 may be formed to varying depths if the thickness of the as-cast article and/or the final article is not constant.

A person of ordinary skill in the art will appreciate that polish marks can be formed using any suitable process in addition to using a drill press. For example, the polish marks also might be formed using a laser or a drill press fitted with automatic ultrasound depth control.

A number of factors in addition to mark depth can be considered when forming polish marks. These factors include, but may not be limited to, placement of the polish marks, the number of polish marks, the spacing of the marks, the polish mark pattern, or patterns, etc.

Polish marks typically are placed at all "thin" sections of the final desired article. This may include the entire as-cast article, or only a portion thereof. For certain golf club heads, marks shall be placed substantially over at least the crown and sole portions of the club head.

The total number of marks used to make each article typically varies from 1 to at least about 550 polish marks, more typically from about 10 to about 100 polish marks, and even more typically from about 20 to about 50 polish marks. The number of polish marks also can vary based on the location of the marks. For example, current processes form about 30 marks on the crown of a club head, about 30 on the skirt, and about 20 on the sole.

The number of marks can also be determined by the area over which the polish marks are made and the spacing of the marks. For example, certain metal woods have a typical crown surface area of about 90 millimeters by 150 millimeters. Thus, if the polish marks are spaced at a set distance, such area and distance establish the number of marks used for a particular portion of the club head. Again by way of example, if the marks are spaced 5 millimeters apart, then the total number of polish marks would be $(90\div5)\times(150\div5)=540$ total polish marks. Mark spacing is determined by the number of marks and the diameter of the mark, with the minimum spacing being determined by forming marks substantially adjacent but not overlapping. Various different polish mark patterns also can be used. A person of ordinary skill in the art will understand that all such factors are best determined by considering (1) producing a final product having a final thickness as desired ± about 0.05 millimeter, and (2) the overall efficiency of the process, as polish mark formation requires processing time.

Figure 3:
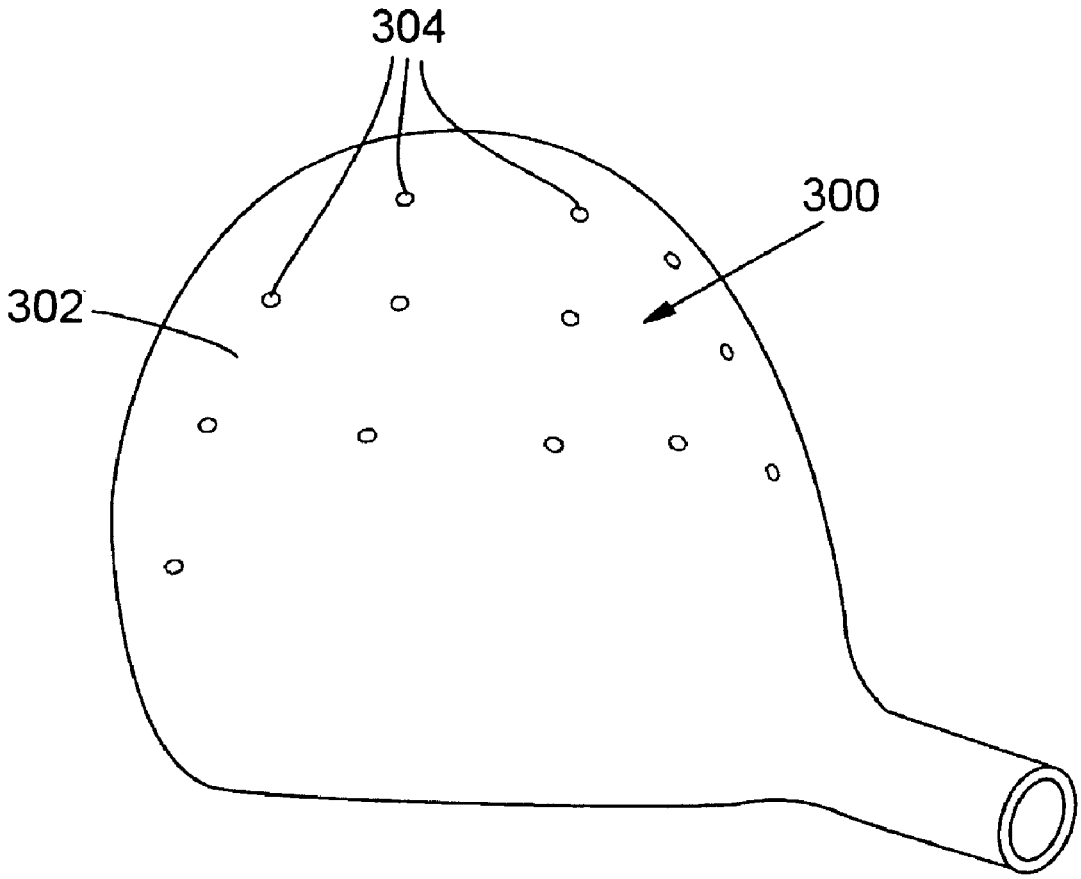
FIG. 3 is a plan view of a golf club head illustrating plural polish marks formed in the crown of the club head prior to polishing to remove the polish marks.

FIG. 3 is a plan view of a club head 300 having a crown 302. Plural polish marks 304 are formed in the crown 302. The polish marks 304 are substantially removed by this polishing process.

Figure 4:
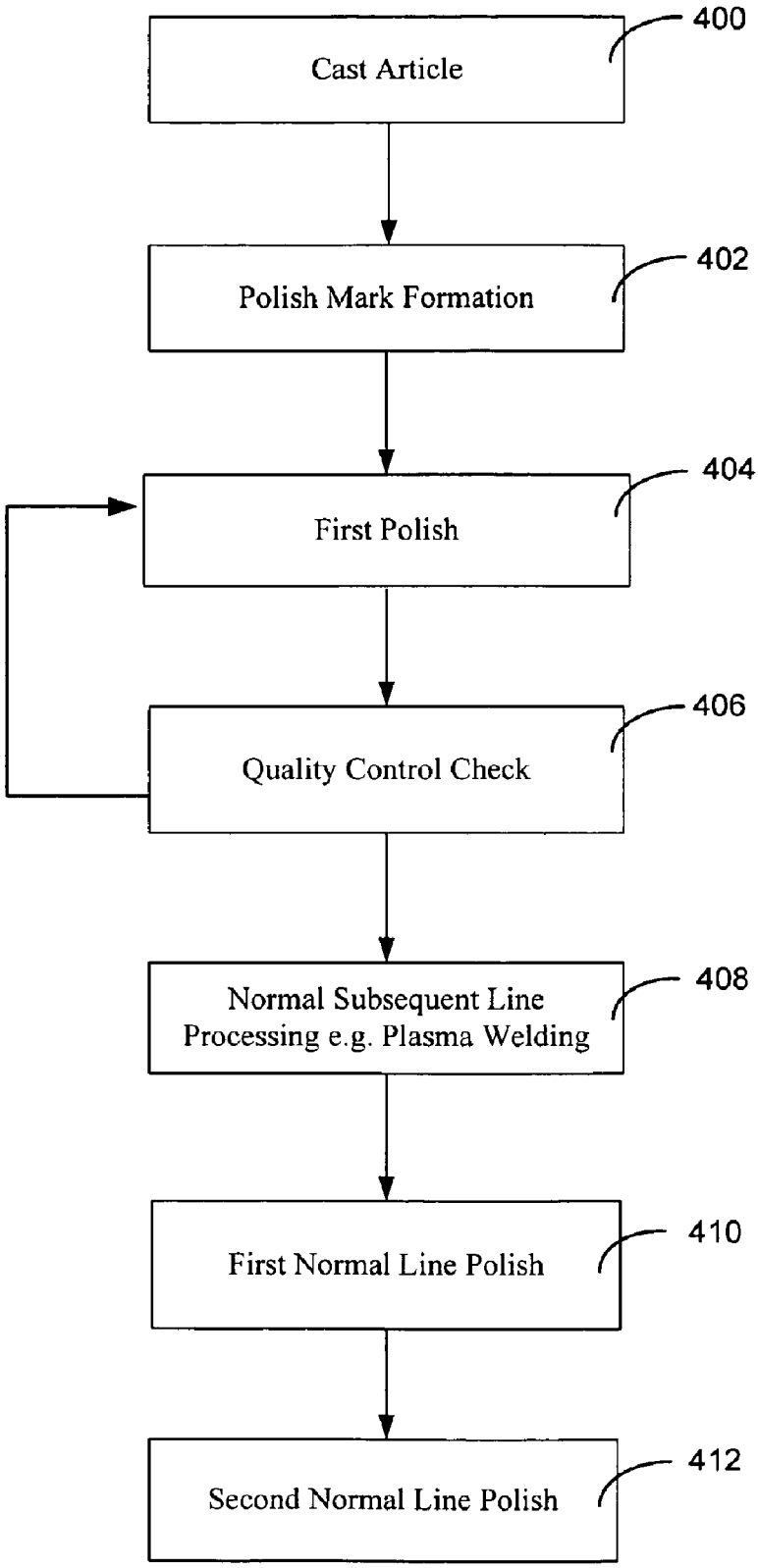
FIG. 4 is a flow chart illustrating one embodiment of a commercial process for making golf club heads according to disclosed embodiments of the present invention.

One embodiment of a commercial process is illustrated in FIG. 4. According to this embodiment an article is first cast in step 400 to produce an as-cast article such as that illustrated schematically by FIG. 2. The as-cast article does not meet thickness specifications for the desired end product. Accordingly, polish marks are formed in the as-cast article in step 402. For a working embodiment, plural polish marks were formed in the article to provide an after-polish thickness of about 0.65 millimeter. For example, in a cast club head, 40 polish marks were formed on the crown, 20 marks were formed on the skirt, and 15 marks were formed on the sole. For this embodiment, polish mark formation required approximately 80 seconds per cast article. However, a person of ordinary skill in the art will appreciate that the number of polish marks used per article is variable.

After polish mark formation, the cast article is subjected to a first polishing step 404. For a working embodiment, the first polish was done using a #180 polish. Polishing was continued until the polish marks were substantially eliminated. The process time for this step for working embodiments was about 70 seconds per article. After this initial polish step 404, the article is then examined in an initial quality check in step 406 to determine if the thickness meets the desired thickness specification ±0.05 millimeter. If not, the part may be subjected to a second polishing step 404.

Once the article meets the desired ±0.05 millimeter specification following initial polishing step 404, the part is then subjected to the next process step typical for producing golf clubs using the cast golf club head. For example, in the illustrated embodiment, the next line step 408 is plasma welding.

The golf club head can then be subjected to a polishing step 410 to further reduce the thickness of the cast article. For example, in the illustrated embodiment, polishing step 410 also was a #180 polish. Polishing step 410 was used to remove about 0.02 to about 0.03 millimeter of material. The article was then weighed. Part weight is an important quality check performed by most manufacturers.

Following polish step 410, a final polish step 412 is conducted. For the illustrated working embodiment, step 412 was a #320 polish that was used to remove about 0.01 to about 0.02 millimeters in thickness. Following this #320 polish, the article is then subjected to a final quality control weight measurement. After the second 320 polish, typical results indicated that at least 90% of the articles, more typically at least about 95%, and even more typically 99%, of the articles produced according to disclosed embodiments of the present invention satisfied the thickness variation specification of ±0.05 millimeter.

The process steps illustrated in FIG. 4 can vary from that stated and still be within the scope of the present invention. For example, more than two polishing steps might be desirable for particular articles. Second, polish grits different from the stated #180 and #320 polishes might be used.

EXAMPLE

The following example is provided to illustrate certain features of working current embodiments. A person of ordinary skill in the art will appreciate that the scope of the invention is not limited to the particular features exemplified by this working example.

Example 1

Figure 5:
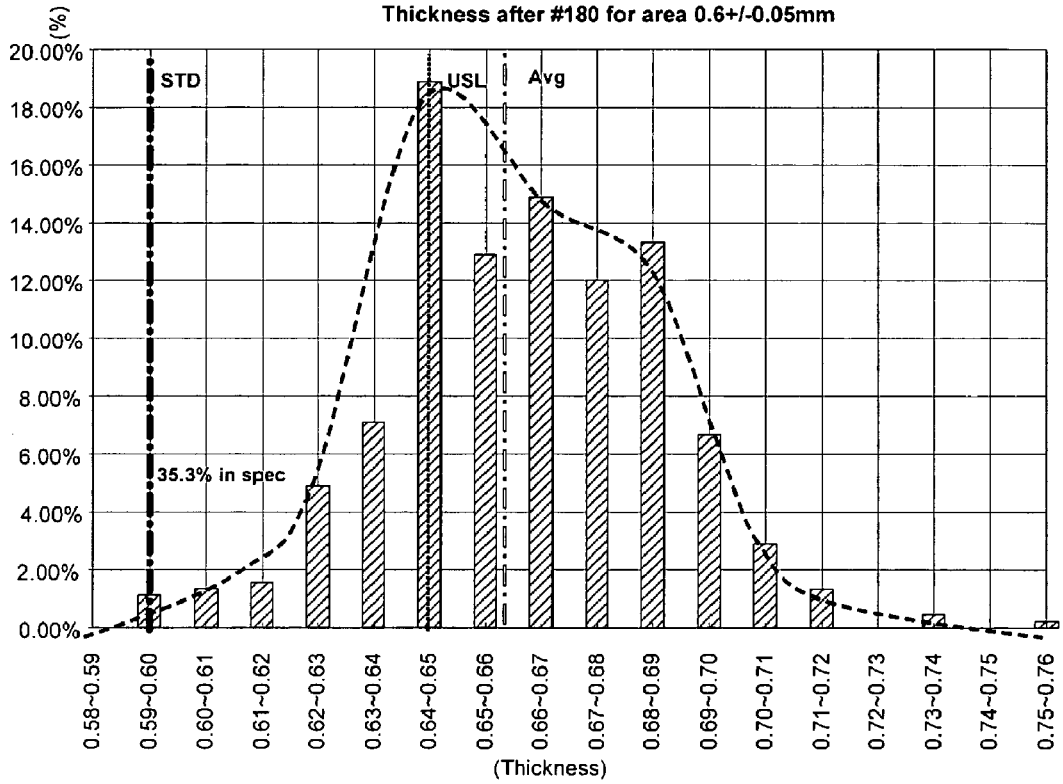
FIG. 5 is a graph of thickness versus percentage of parts having a particular thickness after a first polish establishing that about 35% were in specification after a first polish.

One hundred cast driver heads were produced according to the process outlined by FIG. 4. Following initial #180 polishing step 404, thickness in a thin-walled portion of the driver head was examined using a caliper to determine the number of club heads that were within the desired thickness specification of 0.60±0.05 mm. The results of this initial examination are provided in Table 1 and illustrated in FIG. 5. In Table 1, the acceptable lower statistical limit (LSL) is a thickness of 0.55 mm, and the acceptable upper statistical limit (USL) is 0.65 mm. The thickness of fifty driver heads was measured at six points on the crown and three points on the sole and skirt. After polish mark removal in the #180 polish step, about 35% of the parts were within the desired end specification as shown in Table 2, with the remaining parts exceeding the USL. Moreover, thickness variation of all parts examined was controlled sufficiently for further processing.

Figure 6:
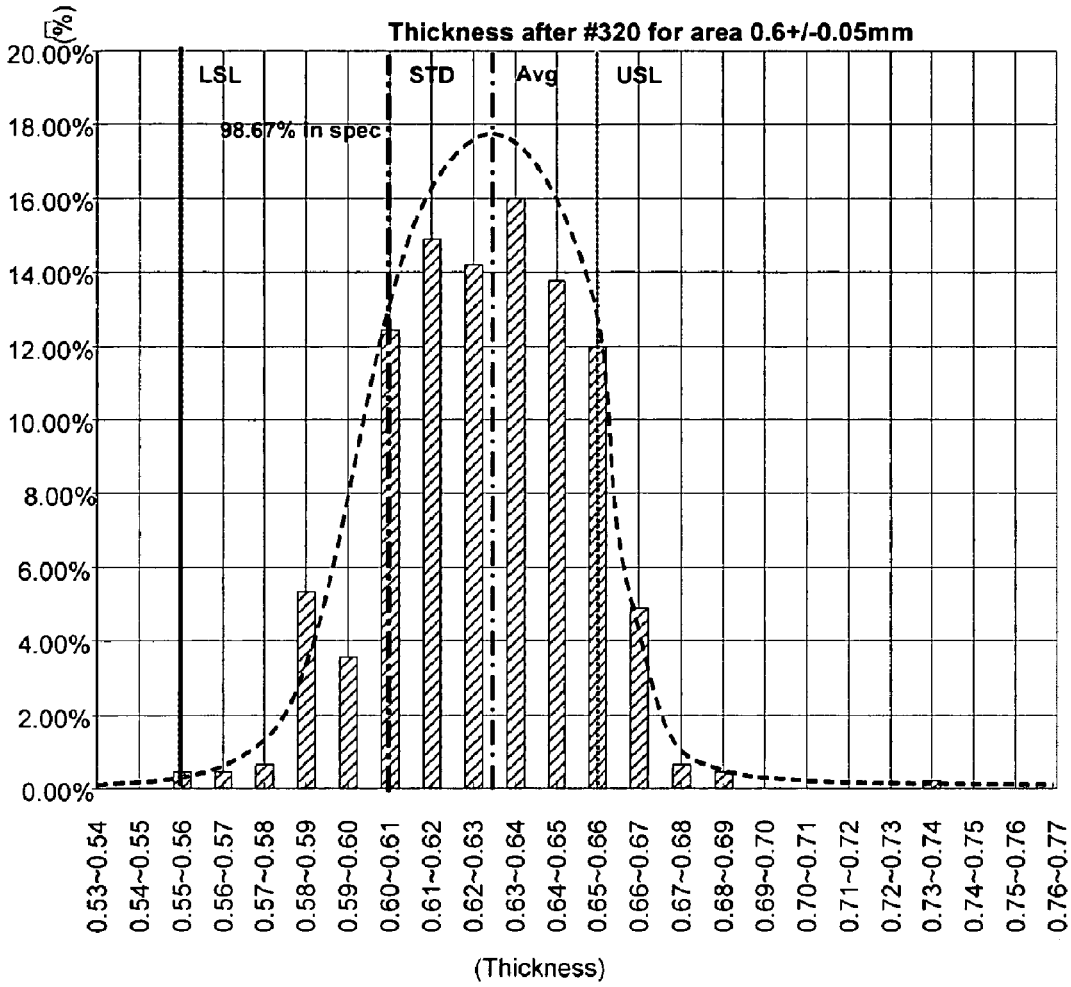
FIG. 6 is a graph of thickness versus percentage of parts having a particular thickness after a second polish, indicating that about 99% were in specification after a second polish.
Figure 7:
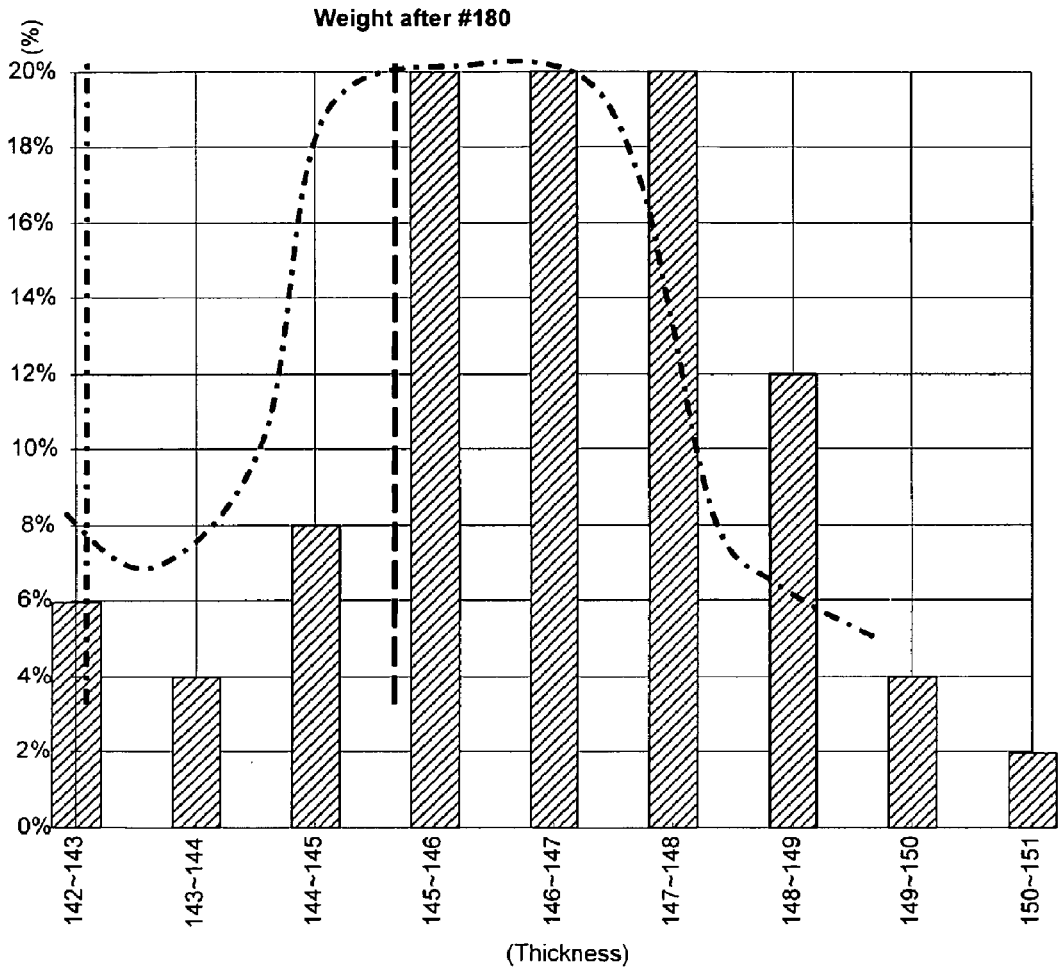
FIG. 7 is a graph of thickness versus percentage of parts having a target weight following a #180 polish.
Figure 8:
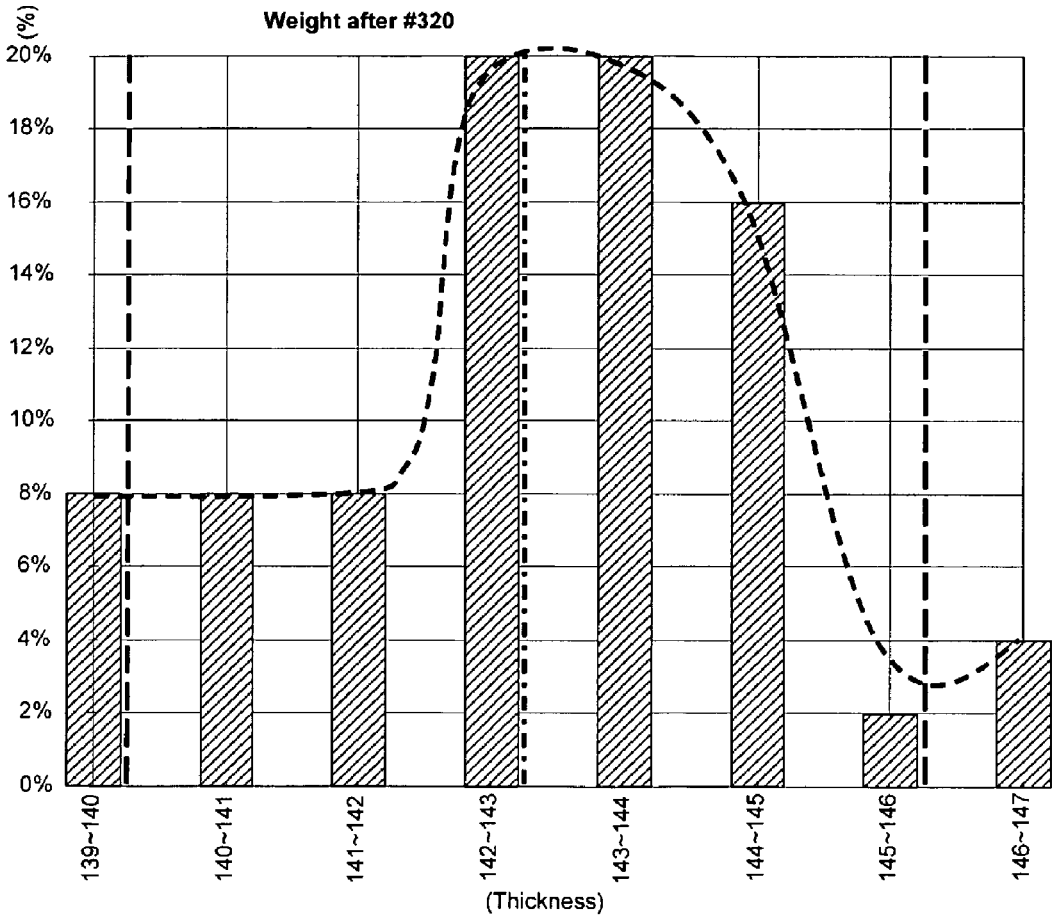
FIG. 8 is a graph of thickness versus percentage of parts having a target weight following a #320 polish.

The articles were then subjected to the second #320 polish step 410. Following this second polish, the articles were again measured using a caliper to determine the thickness variation. The results are shown in Table 3 and illustrated in FIG. 6. In Table 3, the acceptable lower statistical limit (LSL) is a thickness of 0.55 mm, and the acceptable upper statistical limit (USL) is 0.65 mm. The thickness of fifty driver heads was measured at six points on the crown and three points on the sole and skirt. After the second #320 polish step 410, about 99% of the articles satisfied the target thickness variation specification of ±0.05 millimeter as shown in Table 4. Moreover, as indicated by the "Avg." line provided in FIG. 6, the average thickness was about 0.63 millimeters.

TABLE 1

| | | | | | | | | | |
|---|---|---|---|---|---|---|---|---|---|
| | LSL | | | | | | | | |
| | 0.55 | 0.55 | 0.55 | 0.55 | 0.55 | 0.55 | 0.55 | 0.55 | 0.55 |
| | USL | | | | | | | | |
| | 0.65 | 0.65 | 0.65 | 0.65 | 0.65 | 0.65 | 0.65 | 0.65 | 0.65 |
| | SPEC | | | | | | | | |
| | 0.60 + 0.05/−0.05 | | | | | | 0.6 ± 0.05 | | |
| | Head | | | | | | | | |
| | CROWN | | | | | | SOLE & SKIRT | | |
| # | A1 | A2 | A3 | B1 | B2 | B3 | 5.00 | 6 | 7 |
| 1 | 0.67 | 0.67 | 0.65 | 0.70 | 0.70 | 0.69 | 0.68 | 0.68 | 0.62 |
| 2 | 0.65 | 0.68 | 0.68 | 0.69 | 0.68 | 0.67 | 0.69 | 0.65 | 0.69 |
| 3 | 0.69 | 0.69 | 0.67 | 0.69 | 0.69 | 0.70 | 0.66 | 0.66 | 0.68 |
| 4 | 0.65 | 0.65 | 0.64 | 0.76 | 0.65 | 0.71 | 0.65 | 0.67 | 0.67 |
| 5 | 0.68 | 0.69 | 0.66 | 0.69 | 0.68 | 0.68 | 0.69 | 0.71 | 0.69 |
| 6 | 0.68 | 0.64 | 0.66 | 0.70 | 0.70 | 0.65 | 0.68 | 0.69 | 0.65 |
| 7 | 0.64 | 0.67 | 0.65 | 0.68 | 0.68 | 0.66 | 0.69 | 0.71 | 0.63 |
| 8 | 0.65 | 0.65 | 0.66 | 0.69 | 0.69 | 0.66 | 0.70 | 0.70 | 0.69 |
| 9 | 0.66 | 0.64 | 0.65 | 0.70 | 0.69 | 0.65 | 0.66 | 0.72 | 0.63 |
| 10 | 0.65 | 0.65 | 0.66 | 0.69 | 0.67 | 0.65 | 0.66 | 0.67 | 0.68 |
| 11 | 0.65 | 0.65 | 0.65 | 0.66 | 0.65 | 0.65 | 0.66 | 0.68 | 0.61 |
| 12 | 0.66 | 0.65 | 0.64 | 0.63 | 0.66 | 0.64 | 0.64 | 0.64 | 0.67 |
| 13 | 0.65 | 0.67 | 0.65 | 0.67 | 0.65 | 0.65 | 0.67 | 0.71 | 0.66 |
| 14 | 0.66 | 0.67 | 0.69 | 0.70 | 0.69 | 0.69 | 0.68 | 0.67 | 0.60 |
| 15 | 0.70 | 0.67 | 0.70 | 0.71 | 0.68 | 0.68 | 0.71 | 0.74 | 0.67 |
| 16 | 0.65 | 0.65 | 0.67 | 0.66 | 0.69 | 0.70 | 0.60 | 0.63 | 0.69 |
| 17 | 0.66 | 0.65 | 0.65 | 0.66 | 0.69 | 0.65 | 0.65 | 0.69 | 0.69 |
| 18 | 0.66 | 0.65 | 0.69 | 0.66 | 0.70 | 0.69 | 0.71 | 0.74 | 0.67 |
| 19 | 0.63 | 0.66 | 0.64 | 0.66 | 0.66 | 0.64 | 0.63 | 0.69 | 0.63 |
| 20 | 0.67 | 0.65 | 0.65 | 0.69 | 0.67 | 0.72 | 0.65 | 0.69 | 0.68 |
| 21 | 0.68 | 0.68 | 0.69 | 0.70 | 0.70 | 0.71 | 0.62 | 0.65 | 0.64 |
| 22 | 0.67 | 0.64 | 0.64 | 0.66 | 0.69 | 0.60 | 0.65 | 0.67 | 0.68 |
| 23 | 0.68 | 0.66 | 0.70 | 0.67 | 0.69 | 0.67 | 0.58 | 0.58 | 0.63 |

TABLE 1-continued

| | | | | | | | | | |
|---|---|---|---|---|---|---|---|---|---|
| | LSL | | | | | | | | |
| | 0.55 | 0.55 | 0.55 | 0.55 | 0.55 | 0.55 | 0.55 | 0.55 | 0.55 |
| | USL | | | | | | | | |
| | 0.65 | 0.65 | 0.65 | 0.65 | 0.65 | 0.65 | 0.65 | 0.65 | 0.65 |
| | SPEC | | | | | | | | |
| | 0.60 + 0.05/−0.05 | | | | | | 0.6 ± 0.05 | | |
| | Head | | | | | | | | |
| | CROWN | | | | | | SOLE & SKIRT | | |
| # | A1 | A2 | A3 | B1 | B2 | B3 | 5.00 | 6 | 7 |
| 24 | 0.67 | 0.72 | 0.71 | 0.70 | 0.72 | 0.69 | 0.65 | 0.68 | 0.67 |
| 25 | 0.63 | 0.65 | 0.65 | 0.68 | 0.68 | 0.65 | 0.61 | 0.61 | 0.63 |
| 26 | 0.67 | 0.67 | 0.69 | 0.72 | 0.70 | 0.68 | 0.67 | 0.68 | 0.62 |
| 27 | 0.65 | 0.70 | 0.69 | 0.69 | 0.69 | 0.68 | 0.65 | 0.65 | 0.67 |
| 28 | 0.65 | 0.65 | 0.67 | 0.69 | 0.69 | 0.69 | 0.63 | 0.65 | 0.68 |
| 29 | 0.63 | 0.63 | 0.68 | 0.67 | 0.65 | 0.66 | 0.66 | 0.64 | 0.61 |
| 30 | 0.69 | 0.67 | 0.66 | 0.67 | 0.71 | 0.66 | 0.67 | 0.64 | 0.63 |
| 31 | 0.66 | 0.66 | 0.65 | 0.67 | 0.70 | 0.62 | 0.64 | 0.65 | 0.67 |
| 32 | 0.65 | 0.67 | 0.68 | 0.68 | 0.68 | 0.68 | 0.68 | 0.68 | 0.68 |
| 33 | 0.64 | 0.64 | 0.64 | 0.67 | 0.67 | 0.66 | 0.67 | 0.66 | 0.67 |
| 34 | 0.66 | 0.67 | 0.68 | 0.69 | 0.68 | 0.71 | 0.66 | 0.66 | 0.65 |
| 35 | 0.65 | 0.67 | 0.69 | 0.70 | 0.66 | 0.66 | 0.66 | 0.67 | 0.68 |
| 36 | 0.65 | 0.60 | 0.63 | 0.68 | 0.64 | 0.64 | 0.65 | 0.63 | 0.62 |
| 37 | 0.65 | 0.64 | 0.65 | 0.71 | 0.69 | 0.68 | 0.62 | 0.67 | 0.60 |
| 38 | 0.64 | 0.61 | 0.62 | 0.68 | 0.67 | 0.65 | 0.65 | 0.66 | 0.64 |
| 39 | 0.65 | 0.67 | 0.67 | 0.70 | 0.70 | 0.68 | 0.65 | 0.65 | 0.64 |
| 40 | 0.66 | 0.66 | 0.69 | 0.66 | 0.69 | 0.67 | 0.65 | 0.64 | 0.66 |
| 41 | 0.65 | 0.66 | 0.65 | 0.70 | 0.67 | 0.69 | 0.65 | 0.65 | 0.63 |
| 42 | 0.68 | 0.69 | 0.67 | 0.70 | 0.72 | 0.68 | 0.66 | 0.66 | 0.68 |
| 43 | 0.65 | 0.65 | 0.66 | 0.70 | 0.69 | 0.70 | 0.65 | 0.67 | 0.70 |
| 44 | 0.64 | 0.63 | 0.64 | 0.68 | 0.67 | 0.68 | 0.66 | 0.69 | 0.64 |
| 45 | 0.65 | 0.64 | 0.67 | 0.69 | 0.69 | 0.66 | 0.65 | 0.66 | 0.67 |
| 46 | 0.66 | 0.66 | 0.67 | 0.69 | 0.70 | 0.69 | 0.67 | 0.67 | 0.63 |
| 47 | 0.65 | 0.65 | 0.65 | 0.70 | 0.65 | 0.65 | 0.69 | 0.69 | 0.68 |
| 48 | 0.65 | 0.65 | 0.66 | 0.67 | 0.67 | 0.67 | 0.67 | 0.66 | 0.67 |
| 49 | 0.65 | 0.63 | 0.63 | 0.68 | 0.66 | 0.64 | 0.61 | 0.64 | 0.63 |
| 50 | 0.65 | 0.65 | 0.68 | 0.65 | 0.67 | 0.68 | 0.67 | 0.71 | 0.69 |
| LSL | 0.55 | 0.55 | 0.55 | 0.55 | 0.55 | 0.55 | 0.55 | 0.55 | 0.55 |
| USL | 0.65 | 0.65 | 0.65 | 0.65 | 0.65 | 0.65 | 0.65 | 0.65 | 0.65 |
| MEAN = | .66 | .66 | .66 | .68 | .68 | .67 | .66 | .67 | .66 |
| RANGE = | .07 | .12 | .09 | .13 | .08 | .12 | .13 | .16 | .10 |
| STAND. DEV. = | .02 | .02 | .02 | .02 | .02 | .02 | .03 | .03 | .03 |
| MAXIMUM = | .70 | .72 | .71 | .76 | .72 | .72 | .71 | .74 | .70 |
| MINIMUM = | .63 | .60 | .62 | .63 | .64 | .60 | .58 | .58 | .60 |
| 3 STDEV = | .05 | .06 | .06 | .06 | .06 | .07 | .08 | .09 | .08 |
| USL MEAN = | −.01 | −.01 | .02 | −.03 | −.01 | .01 | .01 | .04 | .03 |
| LSL MEAN = | .01 | .03 | .03 | .00 | .02 | .03 | .05 | .03 | .03 |
| LEAST = | −.01 | −.01 | .02 | −.03 | −.01 | .01 | .01 | .03 | .03 |
| CPK = | −.16 | −.12 | .27 | −.55 | −.20 | .13 | .16 | .32 | .31 |

TABLE 2

| | | | | | | | | | | | | |
|---|---|---|---|---|---|---|---|---|---|---|---|---|
| | LSL | | | | | | | | | | | |
| | 0.55 | 0.55 | 0.55 | 0.55 | 0.55 | 0.55 | 0.55 | 0.55 | 0.55 | 0.65 | | |
| | USL | | | | | | | | | | | |
| | 0.65 | 0.65 | 0.65 | 0.65 | 0.65 | 0.65 | 0.65 | 0.65 | 0.65 | 0.75 | | |
| | for 0.60 +/− 0.05 mm | | | | | | | | | | | |
| | CROWN | | | | | | SOLE | | | | | |
| Range | A1 | A2 | A3 | B1 | B2 | B3 | 5 | 6 | 7 | TOTAL | % | |
| 0.58~0.59 | 0 | 0 | 0 | 0 | 0 | 0 | 1 | 1 | 0 | 2 | 0.44% | 35.33% In spec |
| 0.59~0.60 | 0 | 0 | 0 | 0 | 0 | 0 | 0 | 0 | 0 | 0 | 0.00% | |
| 0.60~0.61 | 0 | 1 | 0 | 0 | 0 | 1 | 1 | 0 | 2 | 5 | 1.11% | |
| 0.61~0.62 | 0 | 1 | 0 | 0 | 0 | 0 | 2 | 1 | 2 | 6 | 1.33% | |
| 0.62~0.63 | 0 | 0 | 1 | 0 | 0 | 1 | 2 | 0 | 3 | 7 | 1.56% | |
| 0.63~0.64 | 3 | 3 | 2 | 1 | 0 | 0 | 2 | 2 | 9 | 22 | 4.89% | |
| 0.64~0.65 | 4 | 6 | 6 | 0 | 1 | 4 | 2 | 5 | 4 | 32 | 7.11% | |
| 0.65~0.66 | 21 | 15 | 12 | 1 | 5 | 9 | 13 | 7 | 2 | 85 | 18.89% | |

TABLE 2-continued

| | | | | | | | | | | | | |
|---|---|---|---|---|---|---|---|---|---|---|---|---|
| | LSL | | | | | | | | | | | |
| | 0.55 | 0.55 | 0.55 | 0.55 | 0.55 | 0.55 | 0.55 | 0.55 | 0.55 | 0.65 | | |
| | USL | | | | | | | | | | | |
| | 0.65 | 0.65 | 0.65 | 0.65 | 0.65 | 0.65 | 0.65 | 0.65 | 0.65 | 0.75 | | |
| | for 0.60 +/− 0.05 mm | | | | | | | | | | | |
| | CROWN | | | | | | SOLE | | | | | |
| Range | A1 | A2 | A3 | B1 | B2 | B3 | 5 | 6 | 7 | TOTAL | % | |
| 0.66~0.67 | 9 | 6 | 7 | 7 | 4 | 7 | 9 | 7 | 2 | 58 | 12.89% | 64.67% Over USL |
| 0.67~0.68 | 5 | 11 | 7 | 7 | 8 | 4 | 7 | 8 | 10 | 67 | 14.89% | |
| 0.68~0.69 | 5 | 2 | 5 | 7 | 7 | 10 | 4 | 5 | 9 | 54 | 12.00% | |
| 0.69~0.70 | 2 | 3 | 7 | 11 | 14 | 7 | 4 | 6 | 6 | 60 | 13.33% | |
| 0.70~0.71 | 1 | 1 | 2 | 12 | 8 | 3 | 1 | 1 | 1 | 30 | 6.67% | |
| 0.71~0.72 | 0 | 0 | 1 | 2 | 1 | 3 | 2 | 4 | 0 | 13 | 2.89% | |
| 0.72~0.73 | 0 | 1 | 0 | 1 | 2 | 1 | 0 | 1 | 0 | 6 | 1.33% | |
| 0.73~0.74 | 0 | 0 | 0 | 0 | 0 | 0 | 0 | 0 | 0 | 0 | 0.00% | |
| 0.74~0.75 | 0 | 0 | 0 | 0 | 0 | 0 | 0 | 2 | 0 | 2 | 0.44% | |
| 0.75~0.76 | 0 | 0 | 0 | 0 | 0 | 0 | 0 | 0 | 0 | 0 | 0.00% | |
| 0.76~0.77 | 0 | 0 | 0 | 1 | 0 | 0 | 0 | 0 | 0 | 1 | 0.22% | |
| total | 50 | 50 | 50 | 50 | 50 | 50 | 50 | 50 | 50 | 450 | 100.00% | |

TABLE 3

| | | | | | | | | | |
|---|---|---|---|---|---|---|---|---|---|
| | LSL | | | | | | | | |
| | 0.55 | 0.55 | 0.55 | 0.55 | 0.55 | 0.55 | 0.55 | 0.55 | 0.55 |
| | USL | | | | | | | | |
| | 0.65 | 0.65 | 0.65 | 0.65 | 0.65 | 0.65 | 0.65 | 0.65 | 0.65 |
| | SPEC | | | | | | | | |
| | 0.60 + 0.05/−0.05 | | | | | | 0.6 ± 0.05 | | |
| | Head | | | | | | | | |
| | CROWN | | | | | | SOLE & SKIRT | | |
| # | A1 | A2 | A3 | B1 | B2 | B3 | 5.00 | 6 | 7 |
| 1 | 0.62 | 0.62 | 0.63 | 0.65 | 0.65 | 0.63 | 0.63 | 0.64 | 0.61 |
| 2 | 0.64 | 0.63 | 0.61 | 0.63 | 0.65 | 0.63 | 0.64 | 0.64 | 0.61 |
| 3 | 0.62 | 0.60 | 0.60 | 0.66 | 0.60 | 0.64 | 0.62 | 0.63 | 0.61 |
| 4 | 0.61 | 0.59 | 0.60 | 0.65 | 0.62 | 0.65 | 0.61 | 0.63 | 0.60 |
| 5 | 0.62 | 0.66 | 0.60 | 0.64 | 0.62 | 0.60 | 0.65 | 0.65 | 0.62 |
| 6 | 0.66 | 0.62 | 0.63 | 0.62 | 0.67 | 0.64 | 0.60 | 0.64 | 0.59 |
| 7 | 0.60 | 0.63 | 0.62 | 0.63 | 0.65 | 0.63 | 0.63 | 0.62 | 0.61 |
| 8 | 0.61 | 0.60 | 0.61 | 0.64 | 0.65 | 0.60 | 0.65 | 0.65 | 0.65 |
| 9 | 0.64 | 0.62 | 0.58 | 0.66 | 0.64 | 0.62 | 0.61 | 0.65 | 0.61 |
| 10 | 0.60 | 0.63 | 0.62 | 0.64 | 0.61 | 0.64 | 0.63 | 0.62 | 0.62 |
| 11 | 0.61 | 0.59 | 0.60 | 0.60 | 0.64 | 0.61 | 0.64 | 0.63 | 0.59 |
| 12 | 0.59 | 0.59 | 0.58 | 0.60 | 0.62 | 0.59 | 0.61 | 0.61 | 0.64 |
| 13 | 0.61 | 0.60 | 0.63 | 0.61 | 0.60 | 0.63 | 0.61 | 0.65 | 0.65 |
| 14 | 0.63 | 0.60 | 0.64 | 0.63 | 0.61 | 0.67 | 0.65 | 0.65 | 0.58 |
| 15 | 0.64 | 0.64 | 0.63 | 0.65 | 0.67 | 0.63 | 0.65 | 0.63 | 0.61 |
| 16 | 0.61 | 0.63 | 0.64 | 0.65 | 0.62 | 0.65 | 0.58 | 0.62 | 0.61 |
| 17 | 0.62 | 0.59 | 0.63 | 0.62 | 0.64 | 0.61 | 0.60 | 0.65 | 0.62 |
| 18 | 0.62 | 0.64 | 0.61 | 0.61 | 0.65 | 0.66 | 0.64 | 0.65 | 0.60 |
| 19 | 0.61 | 0.64 | 0.61 | 0.61 | 0.60 | 0.58 | 0.61 | 0.65 | 0.60 |
| 20 | 0.63 | 0.63 | 0.63 | 0.61 | 0.66 | 0.73 | 0.61 | 0.65 | 0.61 |
| 21 | 0.64 | 0.64 | 0.62 | 0.64 | 0.62 | 0.63 | 0.59 | 0.63 | 0.59 |
| 22 | 0.60 | 0.58 | 0.59 | 0.61 | 0.61 | 0.58 | 0.64 | 0.60 | 0.64 |
| 23 | 0.64 | 0.63 | 0.63 | 0.61 | 0.65 | 0.62 | 0.55 | 0.56 | 0.56 |
| 24 | 0.63 | 0.65 | 0.66 | 0.62 | 0.65 | 0.65 | 0.60 | 0.62 | 0.60 |
| 25 | 0.60 | 0.61 | 0.61 | 0.66 | 0.63 | 0.60 | 0.60 | 0.59 | 0.61 |
| 26 | 0.63 | 0.60 | 0.63 | 0.64 | 0.62 | 0.62 | 0.62 | 0.61 | 0.58 |
| 27 | 0.63 | 0.66 | 0.63 | 0.64 | 0.62 | 0.65 | 0.64 | 0.62 | 0.58 |
| 28 | 0.59 | 0.61 | 0.65 | 0.65 | 0.63 | 0.63 | 0.58 | 0.61 | 0.62 |
| 29 | 0.58 | 0.60 | 0.66 | 0.64 | 0.63 | 0.61 | 0.62 | 0.59 | 0.58 |
| 30 | 0.64 | 0.63 | 0.60 | 0.65 | 0.65 | 0.64 | 0.63 | 0.61 | 0.55 |
| 31 | 0.62 | 0.65 | 0.62 | 0.63 | 0.64 | 0.61 | 0.61 | 0.61 | 0.63 |
| 32 | 0.60 | 0.62 | 0.64 | 0.63 | 0.63 | 0.65 | 0.60 | 0.63 | 0.64 |
| 33 | 0.61 | 0.60 | 0.58 | 0.64 | 0.66 | 0.61 | 0.65 | 0.63 | 0.65 |
| 34 | 0.60 | 0.65 | 0.65 | 0.63 | 0.63 | 0.65 | 0.62 | 0.61 | 0.61 |

TABLE 3-continued

| | | | | | | | | | |
|---|---|---|---|---|---|---|---|---|---|
| | LSL | | | | | | | | |
| | 0.55 | 0.55 | 0.55 | 0.55 | 0.55 | 0.55 | 0.55 | 0.55 | 0.55 |
| | USL | | | | | | | | |
| | 0.65 | 0.65 | 0.65 | 0.65 | 0.65 | 0.65 | 0.65 | 0.65 | 0.65 |
| | SPEC | | | | | | | | |
| | 0.60 + 0.05/−0.05 | | | | | | 0.6 ± 0.05 | | |
| | Head | | | | | | | | |
| | CROWN | | | | | | SOLE & SKIRT | | |
| # | A1 | A2 | A3 | B1 | B2 | B3 | 5.00 | 6 | 7 |
| 35 | 0.62 | 0.62 | 0.62 | 0.65 | 0.61 | 0.63 | 0.63 | 0.65 | 0.64 |
| 36 | 0.63 | 0.58 | 0.60 | 0.66 | 0.61 | 0.60 | 0.62 | 0.62 | 0.60 |
| 37 | 0.60 | 0.63 | 0.62 | 0.63 | 0.63 | 0.63 | 0.58 | 0.62 | 0.57 |
| 38 | 0.60 | 0.60 | 0.58 | 0.64 | 0.60 | 0.62 | 0.62 | 0.64 | 0.58 |
| 39 | 0.64 | 0.64 | 0.63 | 0.62 | 0.65 | 0.66 | 0.63 | 0.62 | 0.60 |
| 40 | 0.61 | 0.61 | 0.64 | 0.63 | 0.64 | 0.65 | 0.62 | 0.62 | 0.61 |
| 41 | 0.64 | 0.62 | 0.63 | 0.68 | 0.62 | 0.63 | 0.58 | 0.58 | 0.57 |
| 42 | 0.63 | 0.65 | 0.66 | 0.66 | 0.66 | 0.66 | 0.61 | 0.65 | 0.61 |
| 43 | 0.63 | 0.60 | 0.63 | 0.66 | 0.64 | 0.66 | 0.57 | 0.60 | 0.68 |
| 44 | 0.62 | 0.61 | 0.62 | 0.63 | 0.63 | 0.66 | 0.64 | 0.64 | 0.60 |
| 45 | 0.64 | 0.60 | 0.64 | 0.63 | 0.65 | 0.64 | 0.60 | 0.61 | 0.63 |
| 46 | 0.61 | 0.62 | 0.65 | 0.61 | 0.64 | 0.65 | 0.60 | 0.61 | 0.58 |
| 47 | 0.60 | 0.58 | 0.60 | 0.64 | 0.60 | 0.64 | 0.65 | 0.64 | 0.62 |
| 48 | 0.59 | 0.61 | 0.60 | 0.66 | 0.63 | 0.61 | 0.62 | 0.59 | 0.64 |
| 49 | 0.58 | 0.60 | 0.62 | 0.62 | 0.62 | 0.63 | 0.58 | 0.58 | 0.61 |
| 50 | 0.60 | 0.61 | 0.66 | 0.64 | 0.65 | 0.64 | 0.65 | 0.64 | 0.62 |
| MEAN = | .62 | .62 | .62 | .64 | .63 | .63 | .62 | .62 | .61 |
| RANGE = | .08 | .08 | .08 | .08 | .07 | .15 | .10 | .09 | .13 |
| STAND. DEV. = | .02 | .02 | .02 | .02 | .02 | .03 | .02 | .02 | .03 |
| MAXIMUM = | .66 | .66 | .66 | .68 | .67 | .73 | .65 | .65 | .68 |
| MINIMUM = | .58 | .58 | .58 | .60 | .60 | .58 | .55 | .56 | .55 |
| 3 STDEV = | .05 | .06 | .07 | .05 | .06 | .08 | .07 | .07 | .08 |
| USL MEAN = | −.03 | −.01 | −.02 | .02 | .00 | −.02 | .00 | −.03 | .03 |
| LSL MEAN = | .02 | .04 | .02 | .00 | .03 | −.01 | −.03 | −.02 | −.01 |
| LEAST = | −.03 | −.01 | −.02 | .00 | .00 | −.02 | −.03 | −.03 | −.01 |
| CPK = | −.49 | −.11 | −.33 | −.09 | −.04 | −.28 | −.46 | −.51 | −.15 |

TABLE 4

| | | | | | | | | | | | | |
|---|---|---|---|---|---|---|---|---|---|---|---|---|
| | LSL | | | | | | | | | | | |
| | 0.55 | 0.55 | 0.55 | 0.55 | 0.55 | 0.55 | 0.55 | 0.55 | 0.55 | 0.65 | | |
| | USL | | | | | | | | | | | |
| | 0.65 | 0.65 | 0.65 | 0.65 | 0.65 | 0.65 | 0.65 | 0.65 | 0.65 | 0.75 | | |
| | for 0.60 +/− 0.05 mm | | | | | | | | | | | |
| | CROWN | | | | | | SOLE | | | | | |
| Range | A1 | A2 | A3 | B1 | B2 | B3 | 5 | 6 | 7 | TOTAL | % | |
| 0.53~0.54 | 0 | 0 | 0 | 0 | 0 | 0 | 0 | 0 | 0 | 0 | 0.00% | 0.00% over LSL |
| 0.54~0.55 | 0 | 0 | 0 | 0 | 0 | 0 | 0 | 0 | 0 | 0 | 0.00% | |
| 0.55~0.56 | 0 | 0 | 0 | 0 | 0 | 0 | 1 | 0 | 1 | 2 | 0.44% | 98.67% In spec |
| 0.56~0.57 | 0 | 0 | 0 | 0 | 0 | 0 | 0 | 1 | 1 | 2 | 0.44% | |
| 0.57~0.58 | 0 | 0 | 0 | 0 | 0 | 0 | 1 | 0 | 2 | 3 | 0.67% | |
| 0.58~0.59 | 2 | 3 | 4 | 0 | 0 | 2 | 5 | 2 | 6 | 24 | 5.33% | |
| 0.59~0.60 | 3 | 4 | 1 | 0 | 0 | 1 | 1 | 3 | 3 | 16 | 3.56% | |
| 0.60~0.61 | 10 | 11 | 8 | 2 | 5 | 4 | 7 | 2 | 7 | 56 | 12.44% | |
| 0.61~0.62 | 9 | 6 | 5 | 7 | 5 | 6 | 8 | 8 | 13 | 67 | 14.89% | |
| 0.62~0.63 | 8 | 7 | 8 | 5 | 9 | 4 | 8 | 9 | 6 | 64 | 14.22% | |
| 0.63~0.64 | 8 | 8 | 12 | 10 | 8 | 11 | 6 | 7 | 2 | 72 | 16.00% | |
| 0.64~0.65 | 9 | 5 | 5 | 11 | 7 | 7 | 6 | 7 | 5 | 62 | 13.78% | |
| 0.65~0.66 | 0 | 4 | 3 | 7 | 11 | 8 | 7 | 11 | 3 | 54 | 12.00% | |
| 0.66~0.67 | 1 | 2 | 4 | 7 | 3 | 5 | 0 | 0 | 0 | 22 | 4.89% | |
| 0.67~0.68 | 0 | 0 | 0 | 0 | 2 | 1 | 0 | 0 | 0 | 3 | 0.67% | 1.33% over USL |
| 0.68~0.69 | 0 | 0 | 0 | 1 | 0 | 0 | 0 | 0 | 1 | 2 | 0.44% | |
| 0.69~0.70 | 0 | 0 | 0 | 0 | 0 | 0 | 0 | 0 | 0 | 0 | 0.00% | |
| 0.70~0.71 | 0 | 0 | 0 | 0 | 0 | 0 | 0 | 0 | 0 | 0 | 0.00% | |
| 0.71~0.72 | 0 | 0 | 0 | 0 | 0 | 0 | 0 | 0 | 0 | 0 | 0.00% | |
| 0.72~0.73 | 0 | 0 | 0 | 0 | 0 | 0 | 0 | 0 | 0 | 0 | 0.00% | |
| 0.73~0.74 | 0 | 0 | 0 | 0 | 0 | 1 | 0 | 0 | 0 | 1 | 0.22% | |

TABLE 4-continued

| | | | | | | | | | | | |
|---|---|---|---|---|---|---|---|---|---|---|---|
| | LSL | | | | | | | | | | |
| | 0.55 | 0.55 | 0.55 | 0.55 | 0.55 | 0.55 | 0.55 | 0.55 | 0.55 | 0.65 | |
| | USL | | | | | | | | | | |
| | 0.65 | 0.65 | 0.65 | 0.65 | 0.65 | 0.65 | 0.65 | 0.65 | 0.65 | 0.75 | |
| | for 0.60 +/− 0.05 mm | | | | | | | | | | |
| | CROWN | | | | | | SOLE | | | | |
| Range | A1 | A2 | A3 | B1 | B2 | B3 | 5 | 6 | 7 | TOTAL | % |
| 0.74~0.75 | 0 | 0 | 0 | 0 | 0 | 0 | 0 | 0 | 0 | 0 | 0.00% |
| 0.75~0.76 | 0 | 0 | 0 | 0 | 0 | 0 | 0 | 0 | 0 | 0 | 0.00% |
| 0.76~0.77 | 0 | 0 | 0 | 0 | 0 | 0 | 0 | 0 | 0 | 0 | 0.00% |
| total | 50 | 50 | 50 | 50 | 50 | 50 | 50 | 50 | 50 | 450 | 100.00% |

Whereas the invention has been described in connection with representative embodiments, it is not limited to those embodiments. On the contrary, the invention is intended to encompass all modifications, alternatives, and equivalents as may be included in the spirit and scope of the invention, as defined by the appended claims and as would be appreciated by a person of ordinary skill in the art.

We claim:

1. A method for making a golf club head, comprising:

casting a golf club head or golf club head component having an outer as-cast surface;

forming at least one polish mark into the outer surface to a depth selected to provide a final product thickness subsequent to polishing that is ±0.05 millimeter of a final desired thickness; and polishing the golf club head or golf club head component at least once to remove the at least one polish mark and provide a final desired product thickness ±0.05 millimeter.

2. The method according to claim 1 where casting comprises investment casting.

3. The method according to claim 1 where casting comprises investment casting a titanium or titanium alloy.

4. The method according to claim 1 comprising drilling the at least one polish mark.

5. The method according to claim 1 where the golf club head is a driver or a component of a driver.

6. The method according to claim 1 where the golf club head has a volume of from about 300 cubic centimeters to about 500 cubic centimeters and a final desired wall thickness of from about 0.50 to about 0.70±0.05 millimeter.

7. The method according to claim 1 where the golf club head has a total mass between from about 190 grams to about 210 grams, a golf club head volume from between about 350 cubic centimeters to about 460 cubic centimeters, and a final desired wall thickness of from about 0.60 to about 0.65±0.05 millimeter.

8. The method according to claim 1 further comprising attaching the golf club head to a shaft.

9. The method according to claim 1 where polishing comprises at least an initial polish and at least one second polish.

10. The method according to claim 9 where the initial polish is a #180 polish.

11. The method according to claim 9 where the at least one second polish is a #320 polish.

12. The method according to claim 11 where, following the at least one second polish, about 99% of golf club heads produced by the method are within from about 0.50 to about 0.70±0.05 millimeter.

13. The method according to claim 1 comprising forming plural polish marks.

14. The method according to claim 13 where the plural polish marks are substantially evenly spaced.

15. The method according to claim 13 where the plural polish marks are not substantially evenly spaced.

16. The method according to claim 13 where a portion of the plural polish marks are substantially evenly spaced and a portion of the plural polish marks are not substantially evenly spaced.

17. The method according to claim 13 where the polish marks have a diameter, and a number of polish marks per area of a golf club head component are spaced at a distance greater than the diameter.

18. The method according to claim 13 where plural polish marks are formed on a crown, plural polish marks are formed on a skirt, and plural polish marks are formed on a sole of the golf club head.

19. The method according to claim 18 where from 1 to about 550 polish marks are formed on the golf club head.

20. The method according to claim 18 where from about 10 to about 50 polish marks are formed on each of the crown, the skirt, and the sole of the golf club head.

21. The method according to claim 18 where from about 30 to about 50 polish marks are formed on the crown, from about 10 to about 30 polish marks are formed on the skirt, and from about 10to about 20 polish marks are formed on the sole.

22. A method for making a golf club head, comprising:

investment casting a golf club head to produce an as-cast golf club head having an outer as-cast surface, the golf club head having a final desired wall thickness at some portion thereof of from about 0.5 to about 0.7 millimeter;

drilling plural polish marks into the outer surface to a depth selected to provide a final product thickness of about 0.5 to about 0.7±0.05 millimeter;

performing an initial polish to remove the polish marks; and performing a second polish.

23. The method according to claim 22 comprising investment casting a titanium or titanium alloy.

24. The method according to claim 22 where the initial polish is a #180 polish and the second polish is a #320 polish.

25. The method according to claim 22 where the golf club head is a driver or a component of a driver.

26. A method for making a golf club driver head, comprising:

investment casting a titanium or titanium alloy golf club driver head having an outer as-cast surface, the golf club driver head having a final desired wall thickness at some portion thereof of from about 0.5 to about 0.7 millimeter;

drilling from 10 to 100 polish marks into the outer surface to a depth selected to provide a final product thickness of about 0.5 to about 0.7±0.05 millimeter, at least a portion of the plural marks being formed on a crown, a skirt and a sole of the golf club driver head; and performing an initial polish to remove the polish marks; and performing at least a second polish.

* * * * *